343-700 MS AU 256 EX
11/11/80 OR 4,233,607

United States Patent [19]

Sanford et al.

[11] 4,233,607

[45] Nov. 11, 1980

[54] APPARATUS AND METHOD FOR IMPROVING R.F. ISOLATION BETWEEN ADJACENT ANTENNAS

[75] Inventors: Gary G. Sanford; Robert E. Munson; Thomas A. Metzler, all of Boulder, Colo.

[73] Assignee: Ball Corporation, Muncie, Ind.

[21] Appl. No.: 846,347

[22] Filed: Oct. 28, 1977

[51] Int. Cl.[2] ..... H01Q 1/38

[52] U.S. Cl. ..... 343/700 MS; 343/846; 455/24; 455/78

[58] Field of Search ..... 343/700 MS, 853, 846, 343/885, 745, 180, 840

[56] References Cited

U.S. PATENT DOCUMENTS

| | | | |
|---|---|---|---|
| 1,586,144 | 5/1926 | DeBellescize | 343/180 |
| 2,947,987 | 8/1960 | Dodington | 343/180 |
| 2,998,602 | 8/1961 | Cacheris | 343/775 |
| 3,277,488 | 10/1966 | Hoffman | 343/771 |
| 3,710,333 | 1/1973 | Crom | 343/114 |
| 4,074,270 | 2/1978 | Kaloi | 343/700 MS |

FOREIGN PATENT DOCUMENTS

| | | | |
|---|---|---|---|
| 800466 | 8/1958 | United Kingdom | 343/840 |
| 1293459 | 10/1972 | United Kingdom . | |
| 1321734 | 6/1973 | United Kingdom . | |

*Primary Examiner*—David K. Moore
*Attorney, Agent, or Firm*—Cushman, Darby & Cushman

[57] ABSTRACT

Method and apparatus for improving the r.f. isolation between a transmitting and receiving antenna disposed at respectively corresponding spaced apart but relatively adjacent locations. A special compensation radiator is provided at the transmitting and/or receiving antenna site and fed from the same r.f. input/output which feeds the main antenna. The direction, magnitude and phase of r.f. energy radiated and/or received from the compensating radiator are chosen so as to substantially cancel the undesirable r.f. energy otherwise directly received by the receiving antenna from the transmitting antenna.

20 Claims, 4 Drawing Figures

Fig. 1
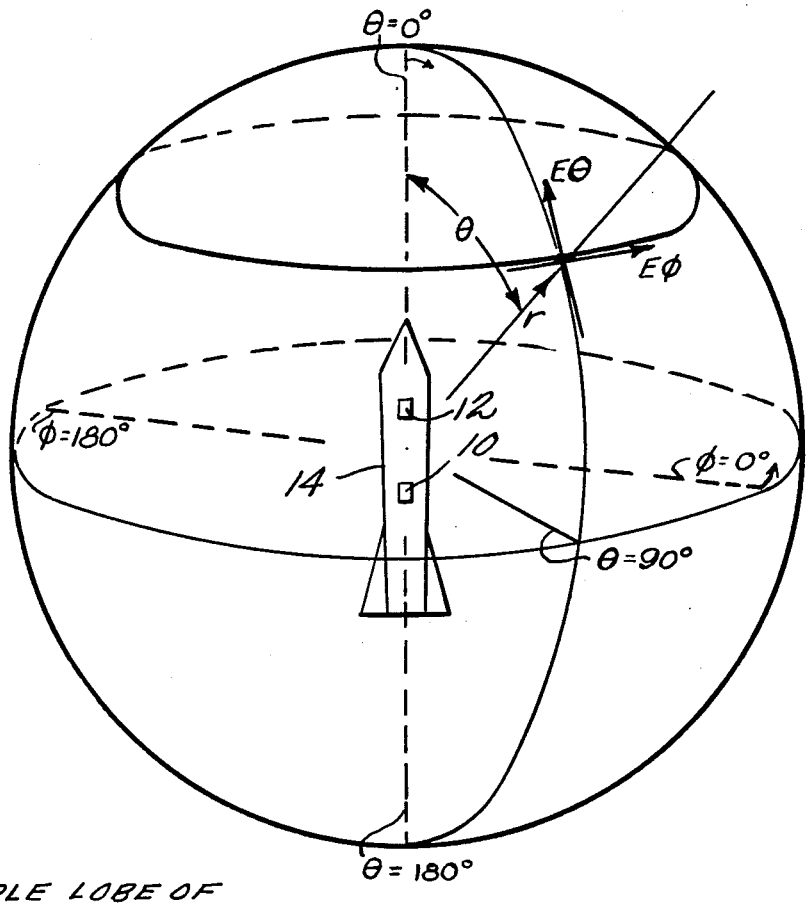
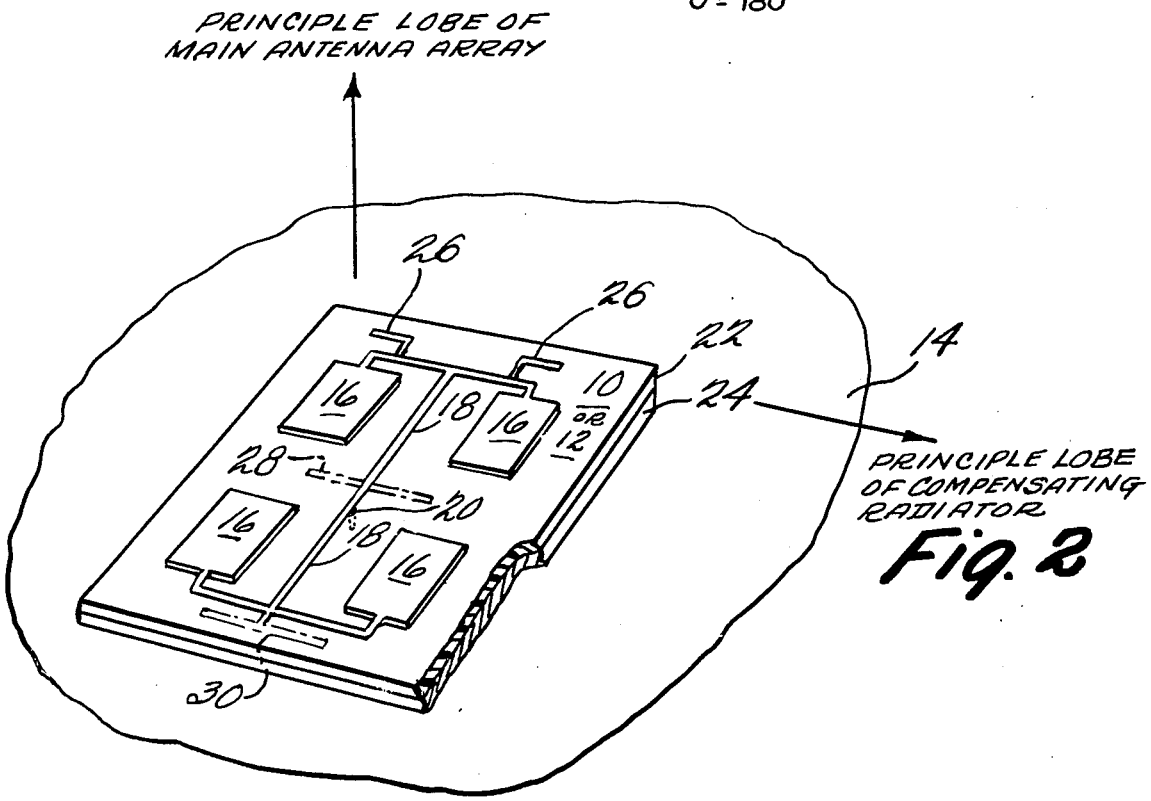
Fig. 2

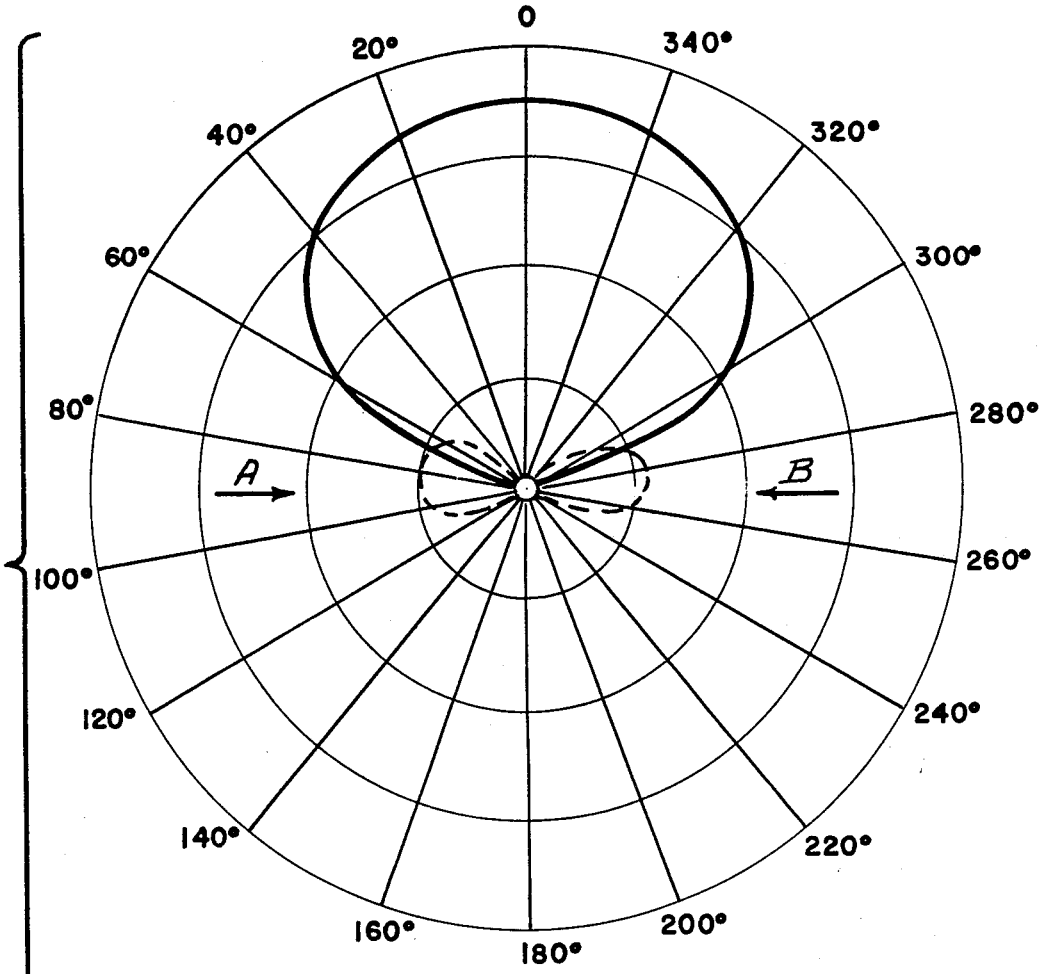
Fig.3
TYPICAL LIKE-POLARIZED (SOLID LINE) AND CROSS-POLARIZED (DASH LINE) RADIATION PATTERN LOBES FOR MICROSTRIP ANTENNA ARRAY ON CYLINDRICAL SURFACE.
Fig.4
RADIATION PATTERN CANCELLATION DUE TO COMPENSATING ELEMENT
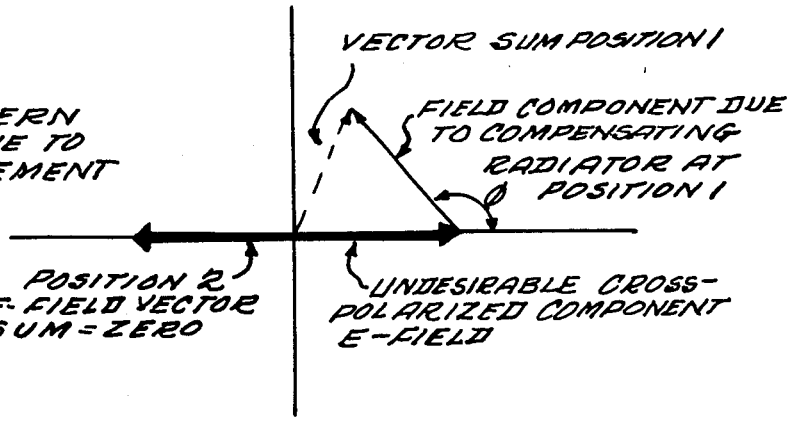

APPARATUS AND METHOD FOR IMPROVING R.F. ISOLATION BETWEEN ADJACENT ANTENNAS

This invention relates to systems of transmitting and receiving antenna structures and, in particular, the presently preferred exemplary embodiment relates to such systems of microstrip antenna arrays.

In many antenna applications, it is necessary to place transmitting and receiving antennas or antenna arrays in close proximity to one another. These various transmitting and receiving antennas may be operating on the same or very nearly the same frequencies. In such cases, direct transmission of r.f. energy from a transmitting antenna to one of the receiving antennas is usually undesirable and efforts are made to isolate the transmitting and receiving antennas insofar as such direct path r.f. transmissions are concerned. This invention is directed to apparatus and method for improving such r.f. isolation.

For example, in a radio frequency altimeter for aircraft, missiles, space craft, etc., it is necessary to maintain a very high degree of r.f. isolation between two relatively adjacent transmitting and receiving antennas operating at substantially the same frequency. Another example of an antenna application requiring high r.f. isolation between relatively adjacent antennas or antenna arrays may be found in duplex communication systems where transmitting and receiving frequencies are substantially similar. Still other antenna applications requiring high r.f. isolation between adjacent transmitting and receiving antennas will be apparent to those in the art.

Since both the transmitting and receiving antennas or antenna arrays will have predetermined three-dimensional radiation patterns associated therewith, one technique for providing some r.f. isolation between the transmitting and receiving antenna is to insure that the principal lobes of these radiation patterns are pointed or directed other than toward the opposite antenna site. However, in spite of these and possibly other conventional techniques for achieving some degree of r.f. isolation between relatively adjacent antenna sites, marginally acceptable r.f. isolation nevertheless often results, especially in the case of microstrip arrays, due to the fact some predetermined amount of transmitted r.f. energy from the transmitting site nevertheless is undesirably directly received at the receiving site.

In particular, such design difficulties have been encountered in the past with microstrip antenna arrays. In general, microstrip radiators are specially shaped and dimensioned conductive surfaces formed on one surface of one planar dielectric substrate, the other surface of such substrate having formed thereon a further conductive surface commonly termed the "ground plane." Microstrip radiators are typically formed, either singly or in an array, by conventional photoetching processes from a dielectric sheet laminated between two conductive sheets. The planar dimensions of the radiating element are chosen such that one dimension is on the order of a predetermined portion of the wavelength of a predetermined frequency signal within the dielectric substrate and the thickness of the dielectric substrate is chosen to be a small fraction of the wavelength. A resonant cavity is thus formed between the radiating element and the ground plane with the edges of the radiating element in the non-resonant dimension defining radiating slot apertures between the radiating element edge and the underlying ground plane surface. For descriptions of various microstrip radiator structures, reference is made to U.S. Pat. Nos. 3,713,162 issued Jan. 23, 1973 to R. Munson et al; 3,810,183 issued May 7, 1974 to J. Krutsinger et al; and 3,811,128 and 3,921,177, respectively, issued on May 7, 1974 and on Nov. 18, 1975 to R. Munson and also to copending applications Ser. Nos. 707,418 filed Aug. 25, 1975 by R. Munson; 596,263, filed July 16, 1975 by J. Krutsinger et al; 620,196 and 683,203 filed Oct. 6, 1975 and May 4, 1976, respectively, by G. Sanford; 658,534, filed Feb. 17, 1976 by L. Murphy; 666,174, filed Mar. 12, 1976 by R. Munson et al; 723,643, filed Sept. 15, 1976 by M. Alspaugh et al; 759,856, filed Jan. 1, 1977 by G. Sanford et al; 783,541, filed Apr. 1, 1977 by R. Munson et al; 783,542, filed Apr. 1, 1977 by R. Munson et al; and 788,603 filed Apr. 15, 1977 by F. Schiavone—all commonly assigned with the present invention to Ball Corporation.

Many such microstrip antenna structures typically utilize a solid dielectric sheet as a substrate, such as Teflon-fiberglass. A continuous conductive sheet is laminated to one side of the dielectric sheet to form the ground plane. Conductive strip elements are formed on the opposing side of the dielectric sheet to form a predetermined configuration of microstrip antenna patches and feedlines, typically by photoetching a continuous conductive sheet previously laminated on the dielectric. Generally, an array of a plurality of antenna patches and associated feedlines are formed as a unitary "printed circuit." The present invention is believed to be useful with substantially all known types of microstrip antenna arrays.

It may also be useful with more conventional types of antenna systems.

According to this invention, improved r.f. isolation is achieved by judiciously extracting r.f. energy of predetermined magnitude and phase from the same r.f. source which supplies the transmitting antenna and by directly radiating such extracted compensating r.f. energy toward the receiving antenna site such that, when received thereat, the compensating r.f. energy substantially cancels the undesirable r.f. energy otherwise directly received from the transmitting antenna site.

At the same time, the receiving antenna is preferably identical to the transmitting antenna—that is, it also includes a compensating radiator which operates in the receiving mode to cancel undesirable direct path transmissions.

In the preferred exemplary embodiment, the compensating radiator is formed integrally with the transmitting and/or receiving microstrip antenna array and comprises a full wavelength radiator fed from the same microstrip transmission line which feeds the normal microstrip radiators in the array. The location of this compensating radiator along the feedlines will determine its relative phase and its non-resonant width will determine the magnitude of r.f. energy which is extracted from the feedline and radiated or which is received and supplied to the antenna output terminals. Such a compensating radiator has an end-fire radiation pattern which is preferably directed toward the opposite antenna site.

Compensation and improved r.f. isolation will be achieved even if this invention is only applied to the transmitter or to the receiver antenna. However, the maximum r.f. isolation will occur when it is applied to both the receiving and transmitting sites.

Using this invention, it has been possible to design microstrip antenna array systems having more than 100 db isolation between transmitting and receiving antenna arrays. This represents an approximately 15–20 db improvement in r.f. isolation previously achieved with closely spaced (on the order of three feet) transmitting and receiving microstrip arrays. With this improved margin of r.f. isolation, antenna measurement and manufacturing problems and tolerances are significantly reduced. In short, this invention presents a systematic procedure for evaluating sources of undesirable r.f. energy causing poor isolation characteristics and a new technique for systematically cancelling such undesirable received radiation.

These as well as other objects and advantages of this invention will be more fully understood by the following detailed description of the presently preferred exemplary embodiment taken in conjunction with the accompanying drawings, of which:

FIG. 1 provides a general depiction of a typical vehicular antenna transmitting and receiving system where this invention finds application together with an exemplary coordinate system useful in describing the invention;

FIG. 2 is a drawing of a typical transmitting or receiving microstrip antenna array according to this invention for use in an antenna system such as that depicted in FIG. 1 thereby providing an improved overall antenna system in FIG. 1;

FIG. 3 is a plot of typical like-polarized (solid line) and cross-polarized (dashed line) radiation lobes for a microstrip antenna array on a cylindrical surface; and FIG. 4 depicts typical vector diagram showing the cancellation of a radiation pattern due to the compensating element of this invention.

As shown in FIG. 1, a transmitting antenna array 10 is often mounted in relatively close proximity to a receiving antenna array 12 on the same electrically conductive surface of an airborne vehicle 14. One such situation may occur in a radio altimeter application where the transmitting antenna 10 has a radiation pattern directed away from the vehicle and where the receiving antenna 12 also has a radiation pattern directed away from the vehicle so as to receive energy transmitted by antenna 10 after its reflection from the earth. Typically, such transmitting and receiving antenna sites may be spaced apart on the order of three feet or so.

For purposes of discussion, the vehicle 14 in FIG. 1 has been placed at the center of a spherical coordinate system where any given point is described by its distance from the origin (r) in conjunction with an azimuth angle ($\phi$) and an elevation angle ($\theta$) measured with respect to the roll axis of the vehicle 14 all as shown diagrammatically in FIG. 1.

Using the coordinate system just described in FIG. 1, an estimate of the r.f. isolation between the two antennas 10 and 12 can be obtained from the Friss Transmission Formula.

$$P_1 = G_1(\theta,\phi)\, G_2(\theta,\phi) \left(\frac{\lambda}{4\pi R}\right)^2 P_2 \qquad \text{(Equation 1)}$$

where $P_1$ = power at receive antenna $P_2$ = power radiated by transmit antenna $\lambda$ = operational wavelength $G_2$, $G_1$ = gain at a given direction for transmit and receive antennas, respectively R = distance separating antennas Equation 1 assumes co-polarized antennas and separation such that the antennas may be considered as operating in their far field, which conditions are normally met in practice. In such a situation, r.f. isolation is given by the ratio $P_1$ divided by $P_2$. For any given antenna separation R and a given operational frequency corresponding to $\lambda$, the space loss factor ($\lambda$ divided by 4 # R) is constant. Accordingly, it follows that the antenna system of FIG. 1 may achieve some degree of r.f. isolation by minimizing the antenna gains along the roll axis ($\phi$=270°, $\theta$=0°). This is, of course, the direction of maximum system interaction along a direct path between the two antenna systems.

In the case of transmitting and receiving antenna systems mounted on a common electrically conductive surface such as vehicle 14 in FIG. 1, no electric fields can exist tangential to the metallic vehicular surface. Accordingly, in such cases, it is only necessary to minimize the gain of the r.f. transmission component normalized in a direction normal to the conductive surface when viewed along the roll axis.

The transmitting and/or receiving microstrip antenna arrays 10 and 12 are shown in more detail at FIG. 2. Here, the usual microstrip radiator elements 16 are fed with integrally formed microstrip transmission lines 18 emanating from a common feed point 20. This entire array is laminated to the top surface of a dielectric layer 22 which is in turn laminated to an underlying ground plane surface 24. This laminated and integrally formed microstrip antenna array structure is then mounted in electrical contact with the conductive skin of vehicle 14 as shown in FIG. 2. As will be appreciated by those in the art, the microstrip radiators 16 have a resonant dimension of substantially one-half wavelength (as measured in the dielectric substrate).

In the exemplary embodiment shown at FIG. 2, a pair of compensating or cancellation radiators 26 has been added and integrally formed in conjunction with the other microstrip radiators and transmission lines. Each compensating radiator 26 is preferably one-half wavelength (as measured in the dielectric substrate) in length and is used to minimize the overall array gain with respect to the undesirable polarization component in a direction along the roll axis. The pair compensating radiators 26 are equivalent to a full wavelength element 28 (dotted lines) or 30 (dotted lines) properly phased by its connection to the feedline. With respect to all the exemplary embodiments (26, 28 and 30), the compensating radiator radiates a linear field polarized along its longitudinal axis. This field can be appropriately adjusted in amplitude and phase so as to substantially cancel the undesirable radiation fields in the direct transmission path along the roll axis to and/or from the receiving antenna 12.

The use of the preferred embodiments causes the compensating r.f. energy to be directed in the end-fire directions with a null at broadside. This is significant since the end-fire direction is also the direction along which the compensating energy must be radiated so as to obtain cancellation along the roll axis. It is also noteworthy that the compensating radiation is polarized in a direction normal to the ground plane surface as required for maximum effectiveness.

The phase of the compensating radiated and/or received energy can be adjusted by simply changing the location of the compensation radiator 26 along the feedline 18. The compensation feed is preferably adjusted so as to provide radiated and/or received energy which is 180° out-of-phase with respect to the undesirable components being transmitted and/or received along the roll axis. At the same time, the amplitude of the radiated compensation energy is directly proportional to the square of the non-resonant dimension (width) of the compensation radiator. Accordingly, by adjusting the width of the radiator, the required field amplitude can be obtained for substantially cancelling unwanted components at the site of the receiving antenna 12.

FIG. 3 simply depicts a typical set of radiation patterns for an antenna array of the type depicted in FIG. 2. The 0° line corresponds to a perpendicular from the metal surface of vehicle 14 and the line $\overline{AB}$ is parallel to the roll axis (e.g., $\theta=0°$). The solid line pattern lobe represents the like-polarized principal lobe of the main antenna array and the dotted line radiation lobe represents the undesired but nevertheless unavoidable cross-polarized radiation from the array directed along the roll axis toward the other array.

FIG. 4 is a vector diagram illustrating the cancellation effect for two different positions or locations of the compensating radiators along the feedline. For example, the undesirable cross-polarized coupling from one array (e.g., 10) to the other (e.g., 12) is depicted as a horizontal vector directed to the right in FIG. 4. If the compensating radiators 26 are located at a first position along the corporate feedline, the resulting field component which is received at array 12 is depicted vectorially having a relative phase angle $\phi$ and the vector sum is shown by dotted lines. As seen in FIG. 4, this does not result in complete cancellation of the undesirable mutual coupling between the antenna arrays. However, if the compensating radiators 26 are located at another position 2, then the field component received at array 12 will be as depicted in FIG. 4 having equal magnitude but a 180° phase difference with respect to the undesired crosspolarized component which is unavoidably also received at the array site 12. The result is substantially complete cancellation when the compensating elements 26 are located at position 2.

The exact position of the compensating radiators and their width will vary from one particular situation to the next depending upon many variables such as the spacing between antenna sites, the configuration of the intervening structures, the particular type of primary array being used, etc. In general, the optimum sizing and positioning of the compensation radiator necessarily involves trial and error techniques. For one particular radio altimeter application at 4.3 $Gh_z$, the radiators 16 were approximately 0.5 by 0.33 wavelength; the transmission line 18 was approximately 0.02 wavelength; the compensating radiators 26 were approximately 0.5 by 0.04 wavelength; the distance from feed point 20 to the radiators 26 was approximately 1.25 wavelength and the antennas 10 and 12 were spaced approximately 34 inches center-to-center. In this example, normal r.f. isolation would have been on the order of −80 db and it was improved by use of this invention to approximately −95 to −100 db. The positioning and sizing of the compensation radiator 26 was chosen by trial and error so as to minimize the overall antenna pattern along the $\theta=0°$ direction.

For most applications, the cancellation or compensating radiator 26 will not materially affect either the input VSWR or the relative phase relationships between the various normally radiating elements 16 of the microstrip array. The r.f. field which must be cancelled is generally small (on the order of −15 to −20 dB) and, accordingly, only a relatively small width for the radiator 26 is required. Accordingly, the center-fed radiator 26 will appear as a very high impedance (essentially two open circuits in parallel) shunted across feedline 18 and resulting in minimal loading of the line 18.

As should be noted, where the element spacing of the normal radiator 16 of an array may not physically permit the location of an additional compensation radiator such as 28, the element may be split into two half-wavelength sections and fed at two corresponding symmetrical phase points on the feedline circuit such as indicated in dotted lines at 28 in FIG. 2. Similarly, the desired full wavelength radiator may be located elsewhere on the dielectric substrate and fed from a separate section of microstrip feedline as shown on dotted lines at 30 in FIG. 2.

While only a few exemplary embodiments of this invention have been described in detail above, those in the art will appreciate that there may be many modifications and variations of these exemplary embodiments which may be made without departing from the novel and advantageous teachings of this invention as defined in the appended claims.

What is claimed is:

1. A system of antenna arrays having improved r.f. isolation therebetween, said system comprising:

a first antenna array and connected first r.f. feedline disposed at a first location for transmitting r.f. energy from an r.f. source according to a predetermined three-dimensional first radiation pattern;

a second antenna array and connected second r.f. feedline disposed at a second location for receiving r.f. energy according to a predetermined three-dimensional second radiation pattern such that some r.f. energy from said first antenna array is undesirably received by said second antenna array; and first and second additional r.f. radiating element means, each being connected to the respectively corresponding said first and second feedlines and disposed at the respectively corresponding one of said first and second locations, said first and second additional r.f. radiating element means being connected to transmit or receive r.f. energy of a predetermined magnitude and phase so as to substantially cancel said r.f. energy undesirably received by said second antenna array.

2. A system of antenna arrays as in claim 1 wherein said additional r.f. radiating element means are constructed and disposed so as to define there own corresponding directive radiation pattern having a lobe thereof directed toward the other of said first and second locations.

3. A system of antenna arrays as in claim 1 wherein said predetermined phase produces a substantially 180 degree phase difference between said r.f. energy undesirably received by said second antenna array and the compensating r.f. energy received by said second antenna array.

4. A system of antenna arrays as in claim 1 wherein said first and second arrays are disposed over a common electrically conductive surface and wherein said additional r.f. radiating element means are constructed and disposed so as to radiate or receive said compensating r.f. energy with an electrical field polarization normal to said common surface.

5. A system of antenna arrays as in claim 2 wherein said predetermined phase produces a substantially 180 degree phase difference between said r.f. energy undesirably received by said second antenna array and the compensating r.f. energy received by said second antenna array.

6. A system as in claim 5 wherein said first and second arrays are disposed over a common electrically conductive surface and wherein said additional r.f. radiating element means are constructed and disposed so as to radiate or receive said compensating r.f. energy with an electrical field polarization normal to said common surface.

7. A system of microstrip antenna arrays having improved r.f. isolation therebetween, said system comprising:

a first array of microstrip r.f. radiators disposed at a first location over an electrically conducting surface and interconnected by microstrip r.f. feedline with an r.f. input terminal so as to transmit input r.f. energy according to a first predetermined radiation pattern;

a second array of microstrip r.f. radiators disposed at a second location over said electrically conducting surface for receiving and supplying r.f. energy to an r.f. output terminal according to a second predetermined radiation pattern;

the principal lobes of said first and second radiation patterns being directed other than toward said second and first locations respectively but with a predetermined amount of the r.f. energy transmitted from said first array at said first location nevertheless being undesirably received by said second array at said second location; and at least one additional microstrip radiator disposed at at least one of said first and second locations and operatively connected with said r.f. input or output terminal thereat so as to radiate or receive compensating r.f. energy having a magnitude and phase which, when received by said second array, will substantially cancel said predetermined amount of r.f. energy undesirably received by said second array at said second location.

8. A system of microstrip antenna arrays as in claim 7 wherein said at least one additional microstrip radiator has a resonant dimension substantially equal to one wavelength at the frequency of said transmitted r.f. energy and oriented so as to direct a substantial portion of the compensating r.f. energy radiated or received therefrom towards the other of said first and second arrays.

9. A system of microstrip antenna arrays as in claim 8 wherein said at least one additional microstrip radiator is connected at its midpoint to a microstrip r.f. feedline emanating from said input r.f. terminal.

10. A system of microstrip antenna arrays as in claim 8 wherein said at least one additional microstrip radiator is connected at its midpoint to said microstrip r.f. feedline and disposed intermediate individual r.f. radiators of said first array.

11. A system of microstrip antenna arrays as in claim 9 wherein the relative phase of compensating r.f. energy radiated or received by said at least one additional microstrip radiator is determined by the length of microstrip r.f. feedline between its connection and said input or output r.f. terminal.

12. A system of microstrip antenna arrays as in claim 7 wherein said at least one additional microstrip radiator comprises two separate radiators having resonant dimension substantially equal to one-half wavelength at the frequency of said r.f. energy and connected to symmetrical equal phase points of said microstrip r.f. feedline.

13. A system of microstrip antenna arrays as in claim 8 wherein the non-resonant dimension of said at least one additional microstrip radiator is related to the magnitude of compensating r.f. energy needed at the second array to substantially cancel said predetermined amount of undesirably received r.f. energy.

14. A system of microstrip antenna arrays as in claim 12 wherein the non-resonant dimension of said two separate radiators is related to the magnitude of compensating r.f. energy needed at the second array to substantially cancel said predetermined amount of undesirably received r.f. energy.

15. A system of microstrip antenna arrays, said system comprising:

first and second arrays of microstrip radiators disposed at respectively corresponding first and second spaced apart locations, at least one of said arrays including at least one radiator element which is constructed and directed towards the other of said arrays to transmit or receive compensating r.f. energy which substantially cancels the r.f. energy otherwise directly transmitted and received between the arrays.

16. A microstrip antenna array comprising:

a plurality of microstrip radiators spaced by a dielectric layer above an electrically conducting surface and connected through an integrally formed microstrip feedline to a common r.f. input terminal, and at least one compensating microstrip radiator integrally formed with said other microstrip radiators and with said microstrip feedline, said compensating microstrip radiator being sized and disposed along said feedline so as to transmit or receive compensating r.f. energy in a predetermined direction which will, at least at one predetermined location, substantially cancel other r.f. energy transmitted or received along said predetermined direction from said other microstrip radiators.

17. An r.f. transmitting and receiving antenna system comprising:

a first antenna and connected first feedline disposed at a first location for transmitting r.f. energy supplied thereto;

a second antenna and connected second feedline disposed at a second location for receiving r.f. energy; and first and second compensating means respectively disposed at said first and second locations and electrically connected to the respectively corresponding said first and second feedlines to radiate or receive r.f. energy in a direction, magnitude and phase which will substantially cancel the r.f. energy otherwise undesirably received by said second antenna from said first antenna.

18. A method for improving the r.f. isolation between an r.f. transmitting antenna and an r.f. receiving antenna disposed at respectively corresponding first and second spaced apart locations said method comprising the step of extracting and radiating additional compensating r.f. energy from the transmitting antenna feedline toward said r.f. receiving antenna and/or receiving and inserting transmitted radiated energy as additional compensating r.f. energy into the receiving antenna feedline at the site of said r.f. receiving antenna, said compensating r.f. energy having a phase and amplitude which substantially cancels the r.f. energy otherwise received directly from said r.f. transmitting antenna.

19. A method as in claim 18 wherein said directing step is performed at the site of said r.f. transmitting antenna by extracting r.f. energy of predetermined magnitude and phase from the same r.f. source supplying said transmitting antenna and by radiating said extracted r.f. energy in the direction of said receiving antenna.

20. A method as in claim 18 wherein said receiving step is performed at the site of said r.f. receiving antenna by extracting r.f. energy of predetermined magnitude and phase from the r.f. fields transmitted thereto by the r.f. transmitting antenna.

* * * * *